US006634521B1

(12) United States Patent
Hwang

(10) Patent No.: US 6,634,521 B1
(45) Date of Patent: Oct. 21, 2003

(54) SHEET REGISTRATION AND DESKEWING SYSTEM WITH INDEPENDENT DRIVES AND STEERING

(75) Inventor: Shyshung S. Hwang, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/229,800

(22) Filed: Aug. 28, 2002

(51) Int. Cl.[7] ..... G07F 11/16
(52) U.S. Cl. ..... 221/228
(58) Field of Search ..... 250/559.38; 399/395; 271/227, 258.01, 265, 228, 268, 277; 400/579; B65H 7/02, 7/10, 9/00, 5/12, 5/02

(56) References Cited

U.S. PATENT DOCUMENTS 5,278,624 A 1/1994 Kamprath et al. ..... 355/317
5,697,609 A * 12/1997 Williams et al. ..... 271/228
5,715,514 A 2/1998 Williams et al. ..... 399/395
5,794,176 A * 8/1998 Milillo ..... 702/150
6,059,284 A 5/2000 Wolf et al. ..... 271/227
6,059,285 A * 5/2000 Suga et al. ..... 271/228
6,135,446 A * 10/2000 Thiemann et al. ..... 271/228
6,374,075 B1 * 4/2002 Benedict et al. ..... 399/395
6,488,275 B2 * 12/2002 Schlageter ..... 271/10.01

* cited by examiner

*Primary Examiner*—Donald P. Walsh
*Assistant Examiner*—Kenneth W Bower
(74) *Attorney, Agent, or Firm*—Perman & Green, LLP

(57) ABSTRACT

An apparatus for calibrating a sheet registering and deskewing device, comprising a plurality of sensors, located along a paper path, to sense a position of a sheet in the paper path at a first position and a second position, and to generate a signal indicative thereof, a pair of independent separately driven drive nips with steering mechanisms located in the paper path for forwarding the sheet from the first position to the second position and a controller, to receive signals from the said plurality of sensors and to generate motor control drive signals for the said pair of independent separately driven drive nips and steering mechanisms so as to induce a corrective action in the movement of the sheet from the first position to the second position in the paper path and to repeat the corrective action until a predetermined position is obtained.

6 Claims, 3 Drawing Sheets

THIS NUMBER WAS CUTOFF ON THE FAX

SHEET REGISTRATION AND DESKEWING SYSTEM WITH INDEPENDENT DRIVES AND STEERING

BACKGROUND OF THE INVENTION

Field of the Invention

This disclosure relates generally to registration of sheets in a feed path and more particularly concerns a steering system for a sheet registration device in a high speed electrographic printing or copying machine.

In a typical electrophotographic printing or copying process, a photoconductive member is charged to a substantially uniform potential. The charged portion of the photoconductive member is exposed to a light image of an original document being reproduced. The charged photoconductive member is selectively discharged by exposure to the light in the irradiated areas. This creates an electrostatic latent image on the photoconductive member corresponding to the original document. This latent image on the photoconductive member is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles of the powder image are fixed permanently to the copy sheet with heat and pressure.

High quality documents in electrophotographic printers and copiers require registration of sheets of paper or other substrate to the photoreceptor for image transfer. Accurate registration control locates the image consistently with respect to the edge of the paper. Many machines use various types of sheet registration devices which sense the position of a sheet at a first location and generates a set of control signals to advance the sheet to arrive at a second location in proper registry and skew. These devices are dependent upon certain physical properties of the registration system being known. If, for example, drive rolls begin to wear, thus changing the diameter, it is possible that the sheet will not be registered in the proper position. It is desirable to have a system which can initially calibrate the sensors of a registration system and the associated drive mechanism and also to have a periodic update to account for wear and slippage and other physical properties which may degrade. A calibration system which will allow the use of inexpensive sensing devices is also desirable.

The following disclosures may relate to various aspects of the present embodiment:

U.S. Pat. No. 5,278,624 Patentee: Kamprath et al. Issue Date: Jan. 11, 1994

U.S. Pat. No. 5,715,514 Patentee: Williams et al. Issue Date: Feb. 3, 1998

Some portion of the foregoing disclosures may be briefly summarized as follows:

U.S. Pat. No. 5,278,624 describes a registration system for copy sheets using a pair of drive rolls and a drive system for commonly driving both drive rolls. A differential drive mechanism is provided for changing the relative angular position of one of the rolls with respect to the other roll to deskew the copy sheet. A control system is supplied with inputs representative of the skew of the copy sheet and controls the differential drive mechanism to deskew the copy sheet.

U.S. Pat. No. 5,715,514 describes a calibration system for a deskewing and registering device for an electrophotographic printing machine. The method includes a) moving a sheet from a first position to a second position along a paper path; b) sensing the position of the sheet at the first position and the second position; c) choosing a correction value to cause the sheet to change a lateral position from the first position to the second position; d) repeating the moving, sensing, and choosing steps until a predetermined adjustment is made when moving the sheet from the first position to the second position to determine a proper calibration value.

SUMMARY OF THE EMBODIMENT

In accordance with one aspect of the present invention there is provided apparatus for calibrating a sheet registration device having independently, separately driven nips.

Pursuant to another aspect of the present embodiment, there is provided an apparatus for calibrating a sheet registering and deskewing device, comprising a plurality of sensors, located along a paper path, to sense a position of a sheet in the paper path at a first position and a second position, and to generate a signal indicative thereof, a pair of independently driven drive nips with steering mechanisms located in the paper path for forwarding the sheet from the first position to the second position and a controller, to receive signals from said plurality of sensors and to generate motor control drive signals for said pair of independently separately driven drive nips and steering mechanisms so as to induce a corrective action in the movement of the sheet from the first position to the second position in the paper path and to repeat the corrective action until a predetermined position is obtained.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT(S)

Figure 1:
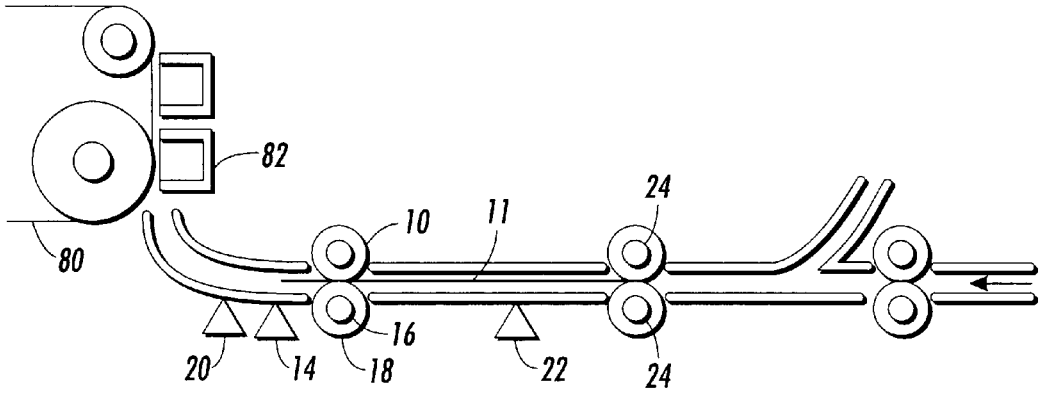
FIG. 1 is a schematic side view of a portion of an embodiment of an electrophotographic printing machine including a sheet registration and deskewing apparatus.

For a general understanding of the features of the present invention, reference is made to the drawings. In the drawings, same reference numerals have been used throughout to identify identical elements. FIG. 1 schematically depicts a section of an electrophotographic marking machine incorporating the features of the present invention therein with a section of a photoconductive belt 80 and an image transfer device 82. The copy sheet 11 is to be registered to the developed image on the photoconductive belt 80 as precisely as possible. Referring to FIG. 1, it shows a side view of a portion of an embodiment of a registration device for an electrophotographic printing machine. In FIG. 1, sheets of paper are advanced to the registration device by rolls 24. A sheet of paper enters nip 10 and a nip 12 disposed behind nip 10 and not visible in FIG. 1. A leading edge sensor 18 detects the sheet of paper and notifies a controller 26 (shown in FIG. 2) that the sheet has entered nips 10 and 12. The registration device of FIG. 1 includes edge sensors 16 and 20 that measure and determine the lateral position and orientation (skew) of the sheet of paper. The lateral position and orientation measurements are used by controller 26 to generate velocity profiles. Leading edge sensors 18 and 14 and edge sensors 16 and 20 are used to evaluate registration accuracy.

Figure 2:
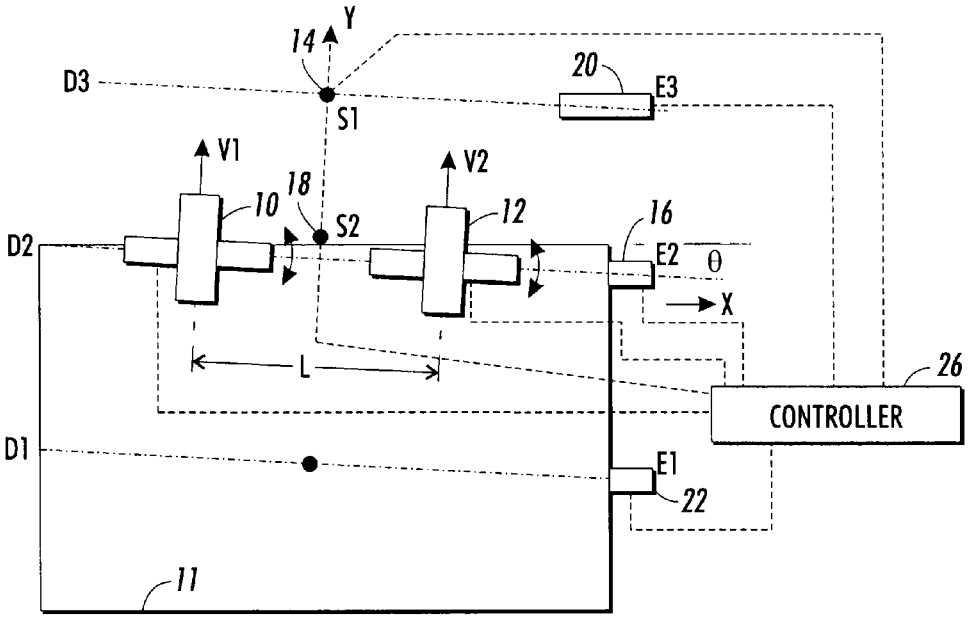
FIG. 2 is a top view of a portion of an embodiment of an electrophotographic printing machine including a sheet registration and deskewing apparatus.

FIG. 2 illustrates a top view of an embodiment of a registration device for a high speed electrographic printing machine including independent drives and steering for registration of a sheet of paper 11. Nip 10 and Nip 12 impose velocities V1 and V2 to the paper, they also steer the paper. Appropriate velocity profiles and steering can register the paper at datum 3 (D3) with proper position and orientation (zero skew).

FIG. 2 shows the sheet of paper 11 as it is entering the registration nip at datum 2 (D2). Leading edge sensor 18 notifies the controller that a sheet has entered nips 10 and 12. Controller 26 regulates the various machine functions. Controller 26 is preferably a programmable microprocessor which controls all the machine functions and is similar to the controller described in U.S. Pat. No. 5,715,514.

Controller 26 provides a comparison count of the copy sheets, the number of documents being recirculated, the number of copy sheets selected by the operator, time delays, jam corrections, etc. The control of all the exemplary systems heretofore described may be accomplished by conventional controls with inputs from the printing machine consoles selected by the operator. Conventional sheet path sensors or switches may be utilized to keep track of the position of the document and the copy sheets. In addition, controller 26 regulates the various positions of the gates depending upon the mode of operation selected.

The lateral position and orientation (skew) of paper 11 are determined from measurements provided by edge sensors 16 and 20. With this information, the registration controller 26 can generate the velocity profiles and steering for registration at datum 3 (D3). The registration accuracy is evaluated at datum 3 (D3) with leading edge sensors 18, 14 (process direction) and edge sensors 16 and 20.

The accuracy of the registration depends on the accuracies of sensors 18, 14, 22, 16, and 20 which measure the position of the paper upon entering of the nips. Candidate sensors to measure the lateral edge position use a light source and a detector. The shadow of the edge is imaged onto the detector and the amount of light measured by a photodiode is a function of the lateral edge position. The non-linearity, offset, temperature drift etc. affect the accuracy of the final registration at datum 3 (D3). U.S. Pat. No. 5,715,514 describes a method for substantially reducing these effects through in-situ real-time calibration.

When the paper arrives at datum 2 (D2) sensors 22 and 16 measure the lateral position of the paper edge. These values determine the lateral displacements required to have the paper registered when it arrives at datum 3 (D3). A request for these displacements is made to the steering algorithm which determines the appropriate nip velocity profiles and steering angles. Sensor inaccuracies caused by nonlinearity, offset, gain errors, temperature drift, etc. cause inaccurate values to be reported to the steering algorithm. Ultimately this results in registration errors. U.S. Pat. No. 5,715,514 describes a method for overcoming this difficulty. The method involves an in-situ determination of a correction that is added to the measured sensor values before they are reported to steering algorithm disclosed in the 5,715,514 patent.

The details of the method and algorithm for calibrating sensor 16 are fully described in U.S. Pat. No. 5,715,514.

In the absence of noise the iteration $$C_{i+1}=C_{i+}X_{s3i} \tag{1}$$

will yield the desired correction. C is the correction to be added to the measured sensor values. $X_{s3i}$ is the lateral position of the paper measured by sensor 20 when the paper is at datum 3 (D3) . In the presence of noise however, it should be modified to $$C_{i+1}=C_{i+}b*X_{s3i} \text{ where } 0<b<1 \tag{2}$$

It can be shown that the factor b has the effect of providing averaging which regulates the stability of the iteration. Smaller values of b increases both stability and the time required to calibrate the sensor.

The method for calibrating the sensor requires feeding sheets of paper to different lateral positions of sensors 16 and 20. The gamut of which must encompass the sensor range. This is difficult to do when feeding out of a paper feeder. A better method moves a single sheet of paper back and forth in the nips many times. On the return move, the nips position the sheet to different lateral positions and orientations at datum 2. This provides the initial conditions for the forward calibration move. The return move can be either deterministic or random. In the results below a random return move was chosen.

The above procedure can also be ganged to adjust the position of a sheet at a third location. The position of the sheet at a third location can be measured and the desired position at the second position can be adjusted accordingly so that the sheet is properly registered at the third location.

As described above, the calibration is a set-up procedure. The calibration may be updated continuously during actual document production. This compensates for drift.

What is described herein is an improved apparatus and method for registration of sheets in an electographic printing machine of the type disclosed in U.S. Pat. No. 5,715,514 in combination with an embodiment of apparatus for steering the independently driven nips 10 and 12 opposite to the skew direction such that the time required to register the sheet can be greatly shortened.

In FIG. 2, controller 26 is connected to the two nips 10 and 12, each formed by two segmented rollers (the bottom two mating rollers not shown), to impose velocities $V_1$ and $V_2$ to the paper 11, thus partly steering the paper. Nips 10 and 12 are further steered to a direction opposite to the skewed θ. Appropriate velocity profiles, $V_1$ and $V_2$, and steering angles $\phi_1$ and $\phi_2$ can register the paper 11 at datum 3 (D3) with proper position and orientation (zero skew). With the addition of steering the two independently driven nips 10 and 12, the registration can be accomplished in a much shorter time.

The relationship between the differential speed and the skew angle without steering can be expressed as:

$$\frac{d\theta}{dt} = \frac{V_2 - V_1}{L}$$

This equation can be integrated to:

$$\theta = \theta_0 + \frac{V_2 - V_1}{L} t$$

with initial skew angle of $\theta_0$. The time required to achieve zero skew is:

$$t = \frac{L}{V_1 - V_2} \theta_0$$

(3)

With the addition of steering the two independently driven nips, the skew angle can be expressed as:

$$\frac{d\theta}{dt} = \frac{V_2 \cos\varphi_2 - V_1 \cos\varphi_1}{L} - 0.5 \frac{d(\varphi_2 + \varphi_1)}{dt}$$

where $\phi$'s are the angle of steering. This equation can be integrated to:

$$\theta = \theta_0 + \frac{V_2 \cos\varphi_2 - V_1 \cos\varphi_1}{L} t - 0.5(\varphi_1 + \varphi_2)$$

For small angle of $\phi_1$, and $\phi_2$, the time required to obtain zero skew is:

$$t = \frac{L}{V_1 - V_2} [\theta_0 - 0.5(\varphi_1 + \varphi_2)] \quad (4)$$

(4)

Comparing Eqs. (3) and (4), it can be seen that the time for registration can be shorten by introducing steering. By adding steering, the time for orientation registration and lateral registration can be improved.

The two velocity vectors for the two independently controlled nips 10 and 12 are also controlled such that the velocity in the cross process, or lateral direction can be the same. This ensures no buckling of the media, or slip in the drive nips. In this feature, referring to FIG. 2, equations for the velocity vectors $V_1$ and $V_2$ of the steerable nips 10 and 12 are as follows:

$$\frac{d\theta}{dt} = \frac{V2y - V1y}{L} - 0.5 \frac{d(\varphi_2 + \varphi_1)}{dt}$$

$$\frac{dx}{dt} = V1x = V2x$$

$$\frac{dy}{dt} = \frac{V2y + V1y}{2}$$

V1x, V2x are x-direction components.

V1y, V2y are y-direction components.

Nip Spacing is L.

V1x=V2x enforces conservation of paper in the x-direction.

The integral of the velocities are the displacements, hence for registration of the sheet:

Lateral (x-direction): prescribe V1x=V2x over a certain interval.

Angular correction: prescribe V2y-V1y, $\phi_1$ and $\phi_2$ over a certain interval.

Process (y-direction): prescribe V2y+V1y over a certain interval.

FIG. 2 shows a sheet of paper enters the registration nips 10 and 12 at datum 2 (D2). Leading edge sensor 18 notifies the controller 26 that a sheet has entered the nips and time stamps the arrival for process direction registration. Paper lateral position and skew are determined from measurements provided by edge sensors 16 and 22. With this information, the registration controller 26 can generate the velocity and steering angle profiles for registration of the sheet 11 at datum 3 (D3). The registration accuracy is evaluated at datum 3 (D3) with the leading edge sensors 14, 18 (process direction) and edge sensors 16 and 20.

Figure 3:
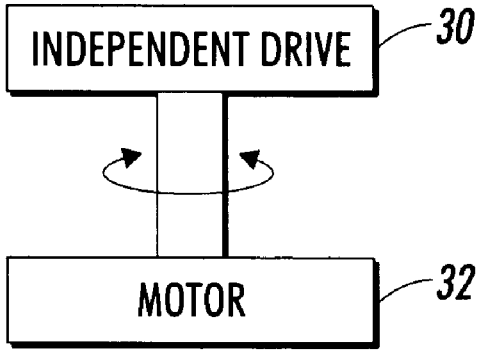
FIG. 3 is an illustration of one embodiment of an independent steering mechanism for the sheet registration and deskewing apparatus of FIG. 2.

The steering of the independently driven nips can be accomplished by many embodiments. FIG. 3 shows a method of rotating an independent nip drive unit 30 using motor 32.

Figure 4:
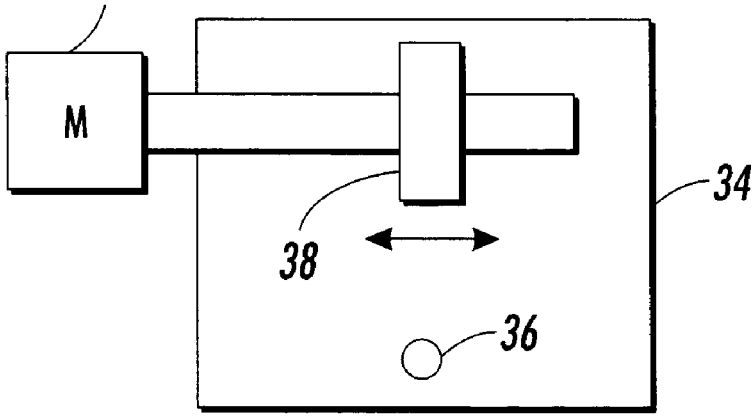
FIG. 4 is an illustration showing an independent drive pivoted from a point and wherein the unit is steered with a rack-and-pinion.

FIG. 4 shows an embodiment wherein an independent nip drive unit 34 that is pivoted from a point 36 and wherein the unit is steered with a rack-and-pinion element 38 connected to motor 40. Other mechanisms, such as recirculating ball, scotch-yoke mechanism, slider-crank mechanism, etc. can also be utilized.

Figure 5:
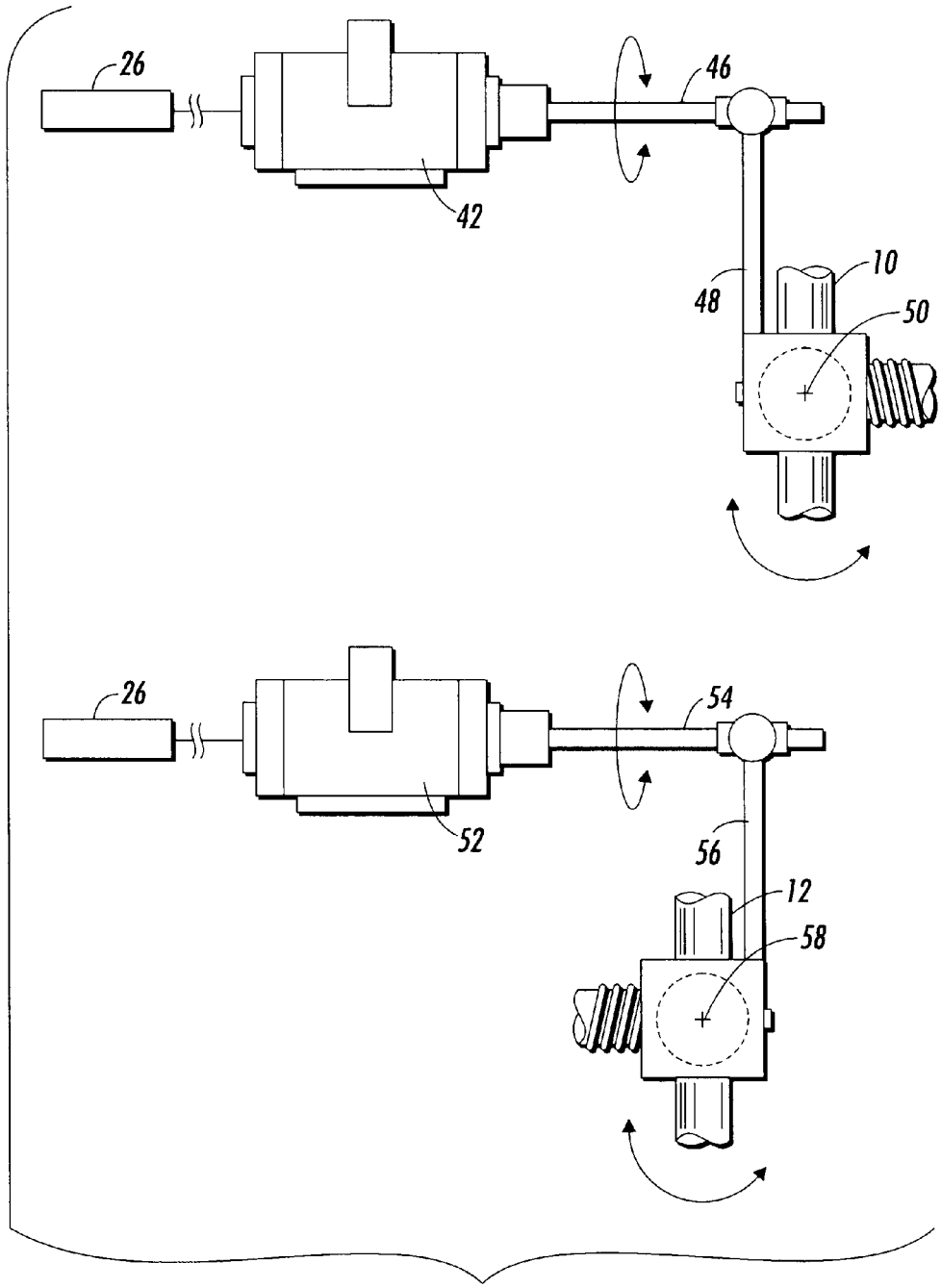
FIG. 5 is a more detailed illustration of an embodiment for independent steering drive nips.

FIG. 5 is a more detailed illustration of an embodiment for independently steering the nips. Drive motor 42 is connected to roll 10 by arm 46 and yoke mechanism 48 such that nip 10 can pivot about point 50. Roll 12 is driven independently of roll 10 by drive motor 52, arm 54 and yoke mechanism 56 which is pivoted about point 58. Drive motors 42 and 52 are controlled by input signals from controller 26 shown in FIG. 2

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A sheet registration and deskewing steering system with independent drives and steering comprising;

a paper path for a sheet;

a steerable drive mechanism for transporting the sheet along the paper path while imparting a lateral motion to the sheet as it is transported along the paper path;

a sensing system for detecting the skew and lateral position of the sheet including a sensor located along the paper path;

a first edge sensor, located along an edge of the paper path; and a second edge sensor located along the edge of the paper path in substantially the same lateral position as the first edge sensor;

a pair of independently, separately driven first and second nips located subsequent to the steerable drive mechanism along the paper path; and a controller connected to the pair of independent and separately driven first and second nips and responsive to a signal from the second sensor for generating first and second drive signals for registering a sheet in the paper path.

2. A sheet registration and deskewing system according to claim 1 wherein the first and second independent and separately driven nips are each rotatable about an axis substantially perpendicular to a plane formed by the paper path and wherein the controller provides separate first and second drive signals to the first and second independent and separately driven nips in response to the second sensor for separately rotating the first and second independent and separately driven nips about the axis.

3. A sheet registration and deskewing system according to claim 2 wherein the first and second independent and separately driven nips each include a motor connected to the controller, an arm and yoke mechanism connected to the motor and a roll rotatably connected to the arm and yoke mechanism.

4. A sheet registration and deskewing according to claim 2 wherein said first and second independent and separately driven nips impose velocities $V_1$ and $V_2$ respectively to produce a skew angle θ to the sheet for steering and registering the sheet having an initial skew angle of $\theta_o$ wherein the relationship between the velocities $V_1$ and $V_2$ is expressed as $$\frac{d\theta}{dt} = \frac{V_2\cos\varphi_2 - V_1\cos\varphi_1}{L} - 0.5\frac{d(\varphi_2 + \varphi_1}{dt}$$

where $\phi_1$ and $\phi_2$ are the angle of steering and L is the distance between the first and second separately driven nips, and wherein $$\theta = \theta_o + \frac{V_2\cos\varphi_2 - V_1\cos\varphi_1}{L}t - 0.5(\varphi_1 - \varphi_2).$$

5. A sheet registration and deskewing according to claim 2 wherein said first and second independent and separately driven nips impose velocities $V_1$ and $V_2$ respectively to produce a a skew angle θ to the sheet for steering and registering the sheet having an initial skew angle of $\theta_o$ wherein the relationship between the velocities $V_1$ and $V_2$ is expressed as $$\frac{d\theta}{dt} = \frac{V2y - V1y}{L} - 0.5\frac{d(\varphi_2 + \varphi_1)}{dt}$$

$$\frac{dx}{dt} = V1x = V2x$$

$$\frac{dy}{dt} = \frac{V2y + V1y}{2}$$

wherein

V1x, V2x are x-direction components,

V1y, V2y are y-direction components and

Nip Spacing in L.

6. The sheet registration and deskewing system of claim 2, wherein said separate rotations of said first and second nips about said axis are at different respective angles of rotation which will avoid buckling of said sheet while imparting said lateral motion to said sheet.

* * * * *